US011203876B2

(12) United States Patent
Delaney et al.

(10) Patent No.: US 11,203,876 B2
(45) Date of Patent: Dec. 21, 2021

(54) METAL OR ALLOY FRAMED INSULATED BUILDING CLADDING SYSTEM

(71) Applicant: FLYNN CANADA LTD., Mississauga (CA)

(72) Inventors: Don Delaney, Toronto (CA); John McManus, Toronto (CA); Tyler Koshurba, Milton (CA)

(73) Assignee: FLYNN CANADA LTD., Mississauga (CA)

( * ) Notice: Subject to any disclaimer, the term of this patent is extended or adjusted under 35 U.S.C. 154(b) by 0 days.

(21) Appl. No.: 16/426,780

(22) Filed: May 30, 2019

(65) Prior Publication Data

US 2020/0378134 A1 Dec. 3, 2020

(51) Int. Cl.

| | |
|---|---|
| ***E04F 13/12*** | (2006.01) |
| ***E04B 2/88*** | (2006.01) |
| ***E04F 13/08*** | (2006.01) |
| ***E04B 1/76*** | (2006.01) |

(52) U.S. Cl.

CPC ..... *E04F 13/12* (2013.01); *E04B 1/7629* (2013.01); *E04B 2/88* (2013.01); *E04F 13/0875* (2013.01); *E04F 13/0894* (2013.01)

(58) Field of Classification Search

CPC ..... E04F 13/12; E04F 13/0875; E04B 1/7629

IPC ..... E04B 1/7629; E04F 13/12,13/0875

See application file for complete search history.

(56) References Cited

U.S. PATENT DOCUMENTS

| | | | | |
|---|---|---|---|---|
| 4,599,838 | A | 7/1986 | Kaminaga | |
| 4,903,454 | A * | 2/1990 | Rose | E04B 2/96 52/235 |
| 8,191,325 | B2 | 6/2012 | Ting | |
| 8,266,851 | B2 * | 9/2012 | Campbell | E06B 1/366 403/187 |
| 8,347,569 | B1 * | 1/2013 | McIntyre | E04F 13/0814 52/235 |
| 8,991,121 | B1 | 3/2015 | Baker | |
| 9,163,399 | B1 * | 10/2015 | Kelley | E06B 3/549 |
| 9,797,143 | B2 * | 10/2017 | Luk | E04F 13/14 |
| 9,988,820 | B2 * | 6/2018 | Komatsu | E04B 9/24 |
| 2003/0150179 | A1 * | 8/2003 | Moreno | E04F 13/0808 52/235 |
| 2007/0022682 | A1 | 2/2007 | Morgenegg et al. | |
| 2010/0146893 | A1 * | 6/2010 | Dickinson | E04B 2/707 52/302.3 |

(Continued)

FOREIGN PATENT DOCUMENTS

| | | |
|---|---|---|
| WO | 2018118536 | 6/2018 |

OTHER PUBLICATIONS

Benchmark by Kingspan, Architectural Building Envelope Solutions, pp. 1-308, Feb. 2019.

(Continued)

*Primary Examiner* — Paola Agudelo

(57) ABSTRACT

A cladding system that is used to form a building envelope is disclosed. The system includes pre-fabricated modular cladding panels, each including a composite layer mounted onto metal or alloy sub-frame. The composite layer provides an outer insulation to the system, and a generally flat outer surface to which a veneer may be mounted. The composite layer further acts as an air and vapour barrier for the building envelope. The sub-frames may connect to one another by a tongue and groove interconnect.

23 Claims, 12 Drawing Sheets

(56) References Cited

U.S. PATENT DOCUMENTS

| | | | | |
|---|---|---|---|---|
| 2015/0184684 | A1* | 7/2015 | Lathief | E06B 3/5871 403/330 |
| 2015/0300017 | A1* | 10/2015 | Carolan | E04B 2/721 52/483.1 |
| 2015/0308125 | A1* | 10/2015 | Helms | E04F 13/0866 52/309.9 |
| 2015/0345152 | A1* | 12/2015 | Libreiro | E04F 13/0891 52/506.05 |
| 2016/0326749 | A1* | 11/2016 | Johnson | E04F 13/0876 |
| 2017/0298634 | A1* | 10/2017 | Marchesi | E04F 13/0814 |
| 2017/0298635 | A1* | 10/2017 | Brochu | E04F 13/076 |
| 2018/0209154 | A1* | 7/2018 | Ausseur | E04F 13/0869 |

OTHER PUBLICATIONS

Rabbet Edge Panels, Mapes Architectural Panels, pp. 1-2.
Glass and Metal Curtain Walls, Best Practice Guide Building Technology, CMHC 2004, pp. 1-257.
BAM South, [Retrieved Apr. 3, 2019], retrieved online via URL: https://www.eews.com/projects/bam-south/.
Performance Appraisal Certificate, Light Gauge Steel Framed Structure with Infill Concrete Panel (LGSFS-ICP) Technology, Dec. 4, 2016, 52 pages.
BAM South in Brooklyn, New York, Prism, Jul. 18, 2018, 8 pages.

* cited by examiner

METAL OR ALLOY FRAMED INSULATED BUILDING CLADDING SYSTEM

TECHNICAL FIELD

This relates to building materials, and particularly to building claddings or curtain walls, and more particular to modular or unitized cladding systems.

BACKGROUND

Modem building facades may be formed of building cladding that is not load bearing. Such cladding is often referred to as a curtain wall. Curtain walls may be mounted to the main building structure through connections at floors or columns of the building.

Curtain wall systems are typically designed with aluminium or steel framing members. The aluminium frame is typically in-filled with glass, which provides an architecturally pleasing appearance to the building exterior. Other common infills include stone veneer, metal panels, louvres, and operable windows or vents.

Such curtain walls may be formed by attaching a sub-frame to a building or structure and attaching the curtain wall framework elements thereto. In-fills are then installed in the framework. This approach is often referred to as the "stick" approach. Alternatively, the curtain wall may be pre-assembled in modules or units, which are applied to a building. Such curtain wall system are referred to as "unitized" or "modular". An overview of curtain wall systems, is for example provided in Glass and Metal Curtain Walls (Best practice guide, building technology)—Public Works and Government Services Canada, ISBN 0-660-19394-9, the contents of which are hereby incorporated by reference.

To the extent that buildings clad by curtain walls must meet certain thermal requirements, additional insulation is typically formed interior to the curtain walls. The curtain walls themselves provide limited insulation. Curtain wall sub-frames often detracts from any insulation properties of the curtain wall as it is typically exposed.

Accordingly, there is a need for improved curtain wall/cladding systems.

SUMMARY

Accordingly, a cladding system includes modular cladding panels, each including a composite layer mounted onto metal or alloy sub-frames. The cladding panels may be pre-manufactured to the dimensions of a specific building, and mounted on the exterior of the building. Cladding panels may be mounted vertically and horizontally adjacent to each other. The composite layer provides an outer insulation to the system, and a generally flat outer surface to which a veneer may be mounted. The composite layer further acts as an air and vapour barrier for the building envelope. The sub-frames may connect to one another by a tongue and groove interconnect to form a complete building envelope.

In an aspect, there is provided a modular cladding system for mounting to the exterior of a building, comprising: a plurality of cladding panels pre-manufactured for mounting the exterior of the building, each cladding panel comprising a frame, comprising vertical top and bottom transoms; and a plurality of mullions extending therebetween; a cladding layer formed of opposed metal layers and an insulating core to which the opposed metal layers are adhered. The cladding layer is formed in front of the frame and thermally insulates the frame, once installed to the exterior of the building.

In another aspect, there is provided a building envelope, comprising a modular cladding system mounted to the exterior of the building, the building envelope comprising: a plurality of pre-manufactured cladding panels, mounted adjacent to each other on the exterior of the building, each cladding panel comprising a frame, comprising vertical top and bottom transoms; and a plurality of mullions extending therebetween; a cladding layer formed of opposed metal layers and an insulating core to which the opposed metal layers are adhered; insulates the frame, once installed to the exterior of the building; and a plurality of weather strips formed between the cladding layer of adjacent cladding panels to seal the building envelope.

Other features will become apparent from the drawings in conjunction with the following description.

BRIEF DESCRIPTION OF THE DRAWINGS

In the figures which illustrate example embodiments.

DETAILED DESCRIPTION

Figure 1:
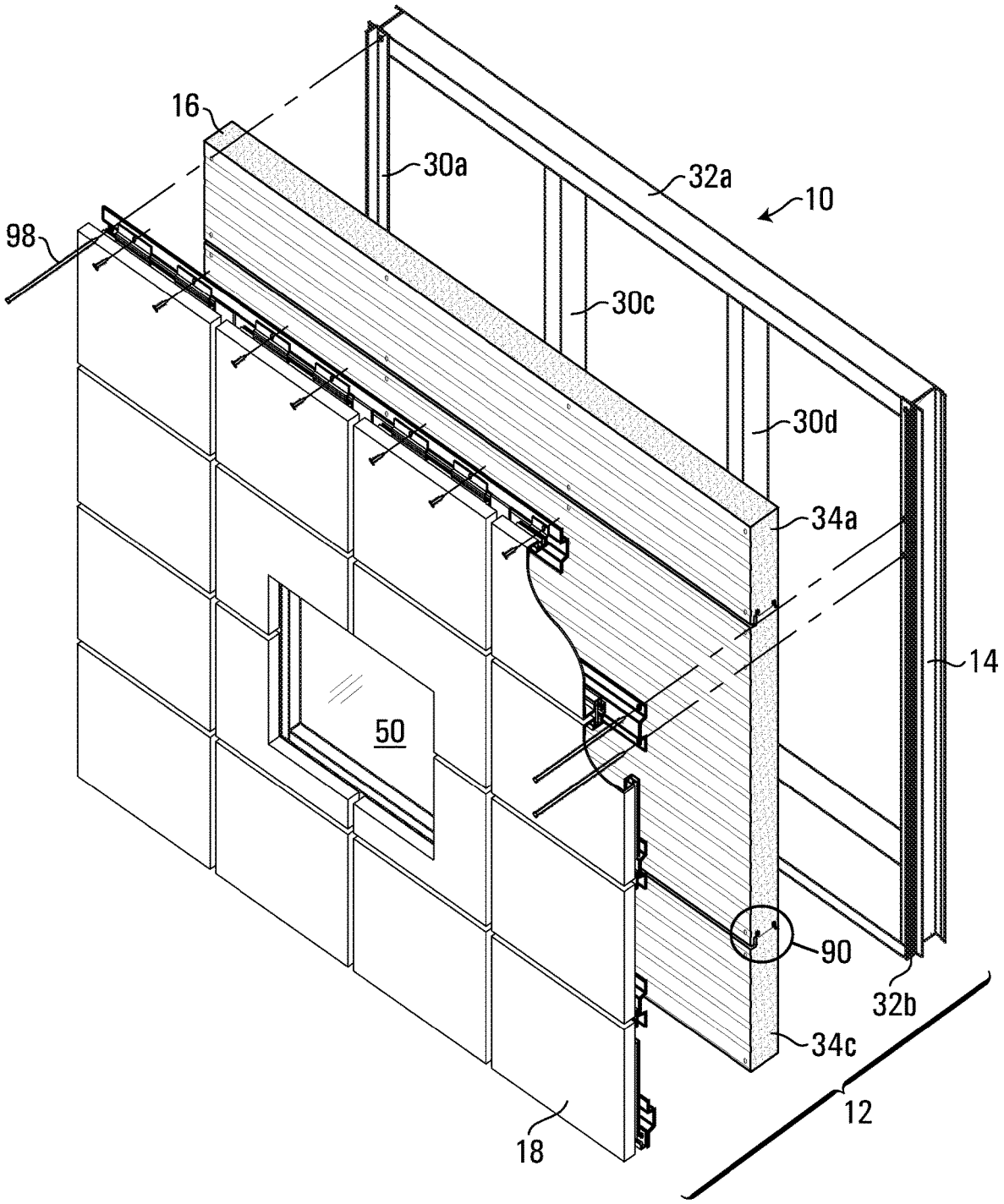
FIG. 1 is a perspective, exploded view of a cladding panel of an example cladding system.
Figure 2:
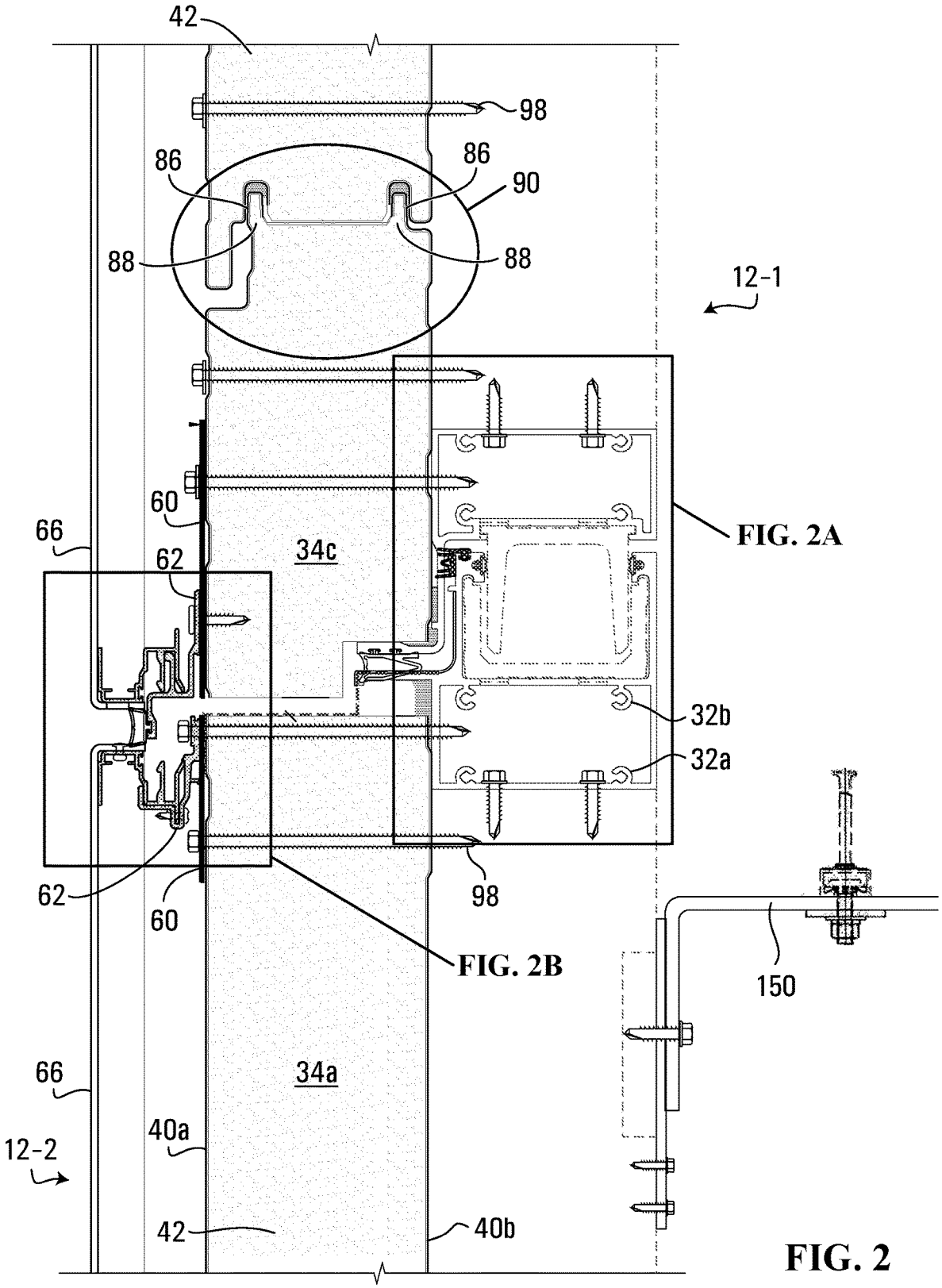
FIG. 2 is a partial side cross-sectional view of two cladding panels of the system of FIG. 1, mounted to a building/structure.
Figure 2A:
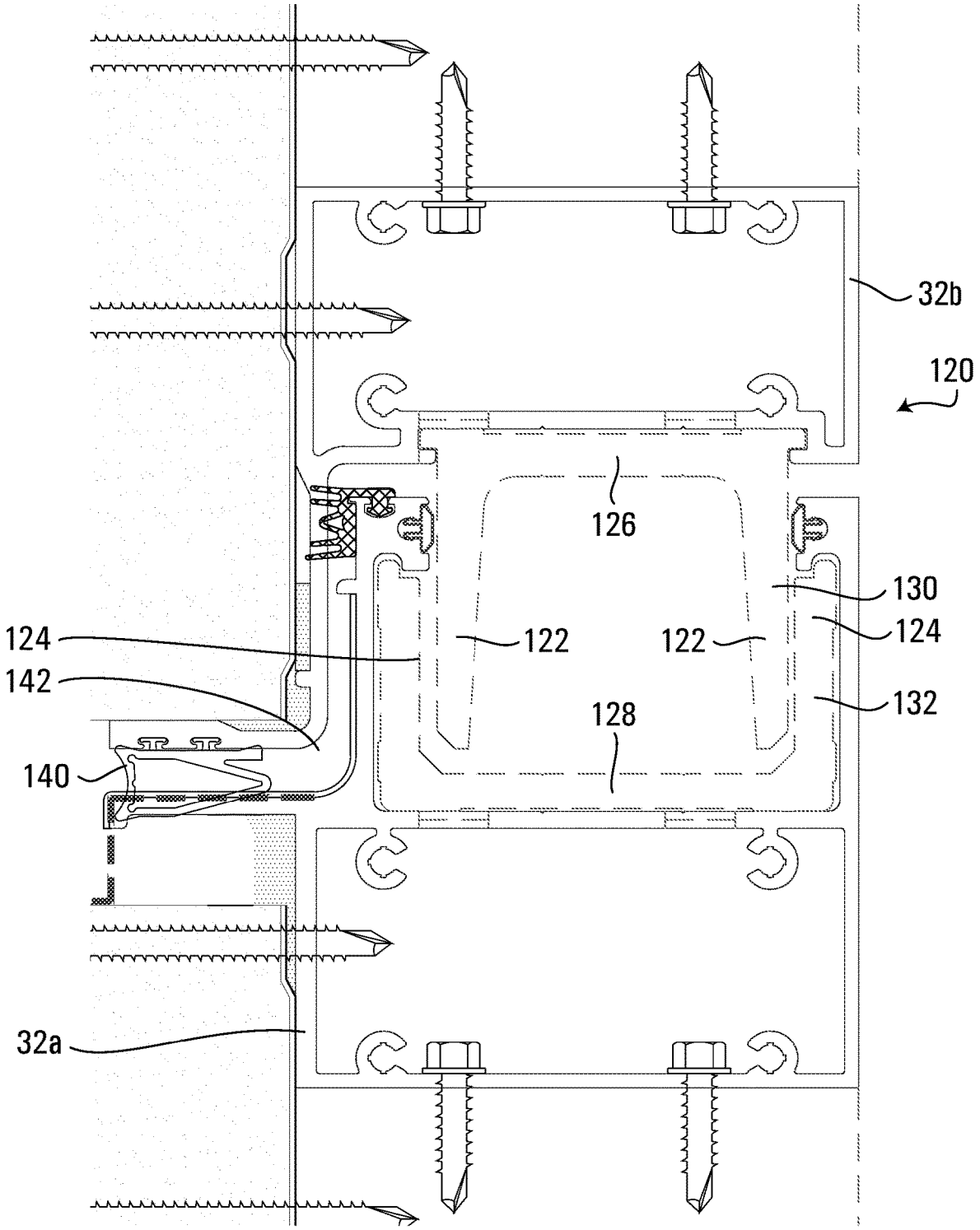
FIG. 2A is an enlarged view of a portion of FIG. 2.
Figure 8:
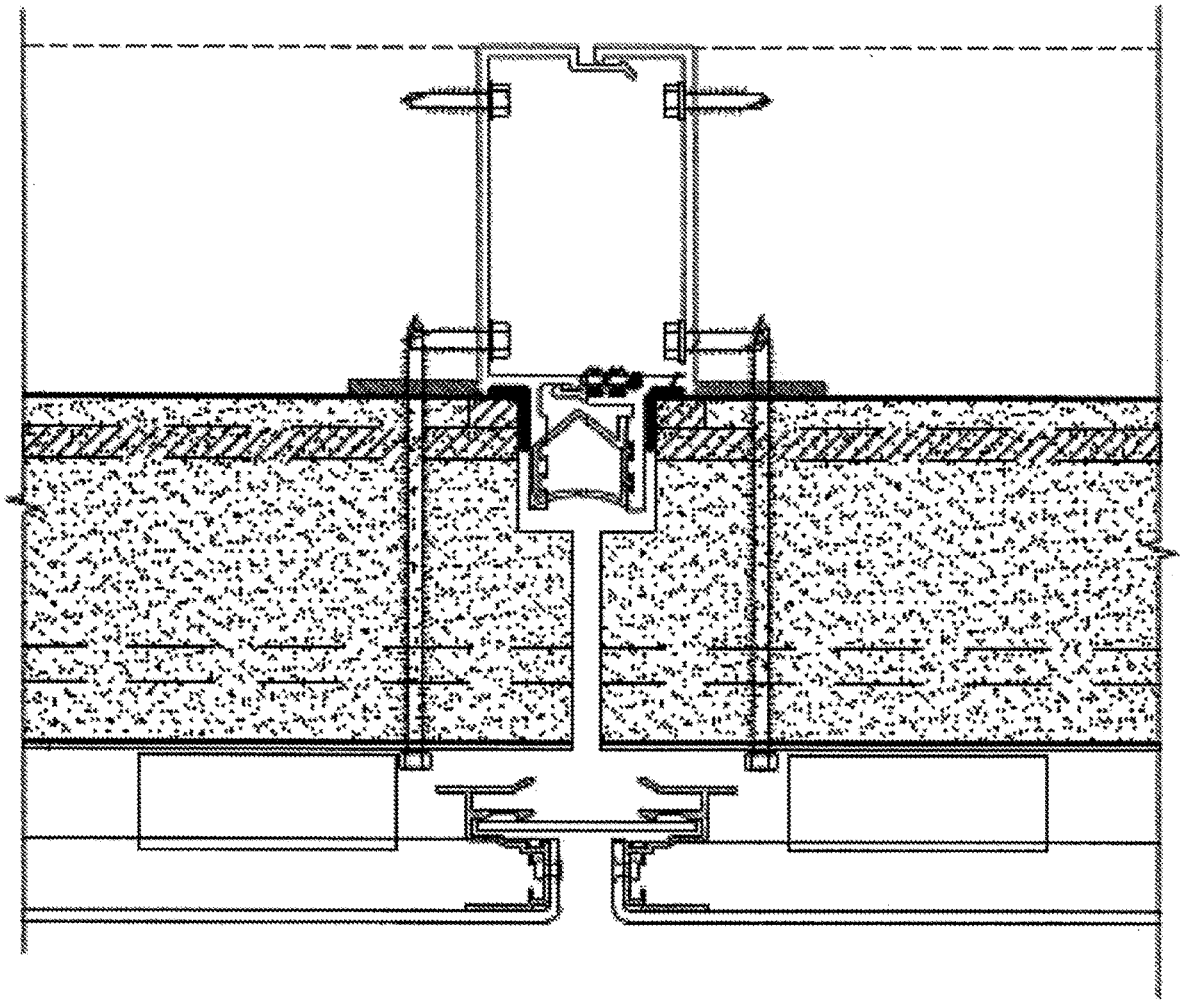
FIG. 8-10 are top plan views of a portion of the cladding system of FIG. 2, mounted to a building structure.
Figure 9:
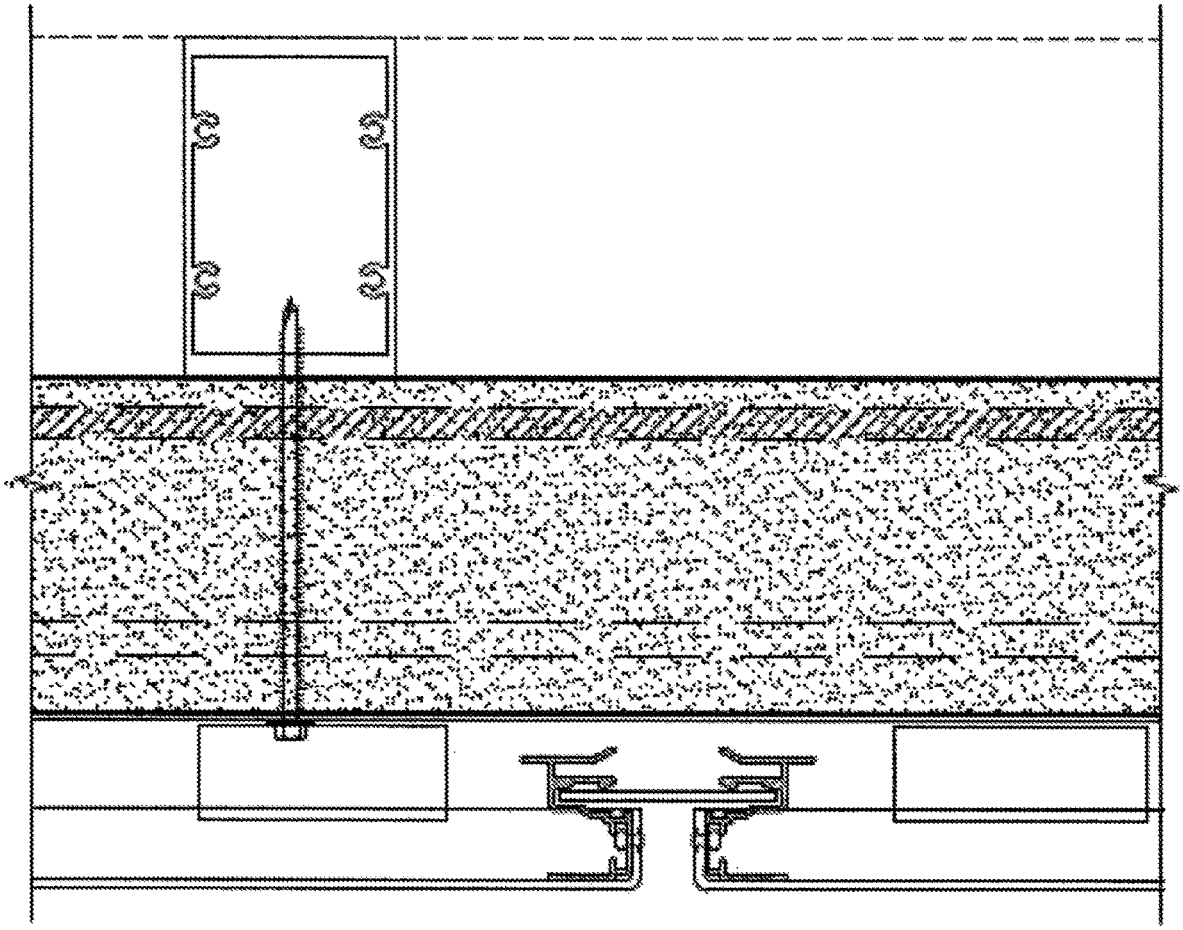
Figure 10:
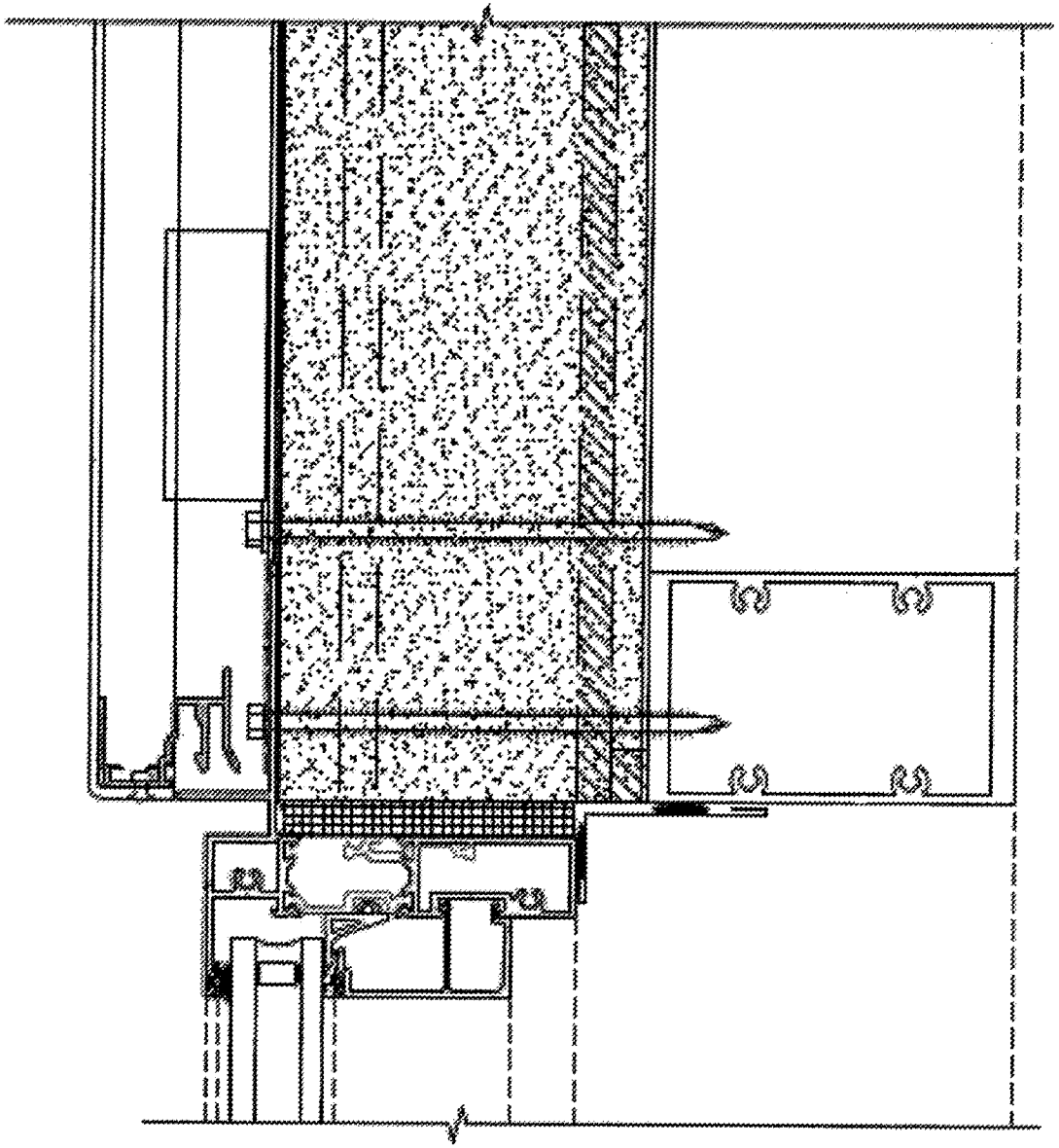

FIG. 1 depicts a cladding system 10, exemplary of an embodiment. Cladding system 10 is applied to the exterior of a structure—such as an office building, residential building, warehouse, house or similar structure. Cladding system 10 is particular well suited to clad the exterior of multiple story structures—such as high rise office buildings, or residential buildings. Cladding system 10 is modular (or unitized) and includes a plurality of pre-assembled cladding panels 12. A single cladding panel 12 is depicted in FIG. 1. FIGS. 2 depicts two such panels 12-1, 12-2 (individually and collective cladding panel 12), vertically adjacent to each other. FIG. 8 depicts two such panels 12, horizontally adjacent to each other.

Cladding system 10 may be used to clad the entirety of a structure, by pre-measuring the structure, and determining the size and mounting location of suitably sized panels 12. Cladding panels 12 may be mounted vertically and horizontally adjacent to each other, as describe below. Cladding system 10 when so installed may form a building envelope. Cladding system 10 may be used to clad newly erected structures, or to re-clad existing structures Cladding system 10, when attached to a structure is not load bearing. Instead, it is attached externally to load bearing elements of the structure. For example, each cladding panel 12 may be attached to floors and pillars of the structure, as further described below. As will be explained, each cladding panel 12 may be mounted to the structure using suitable anchors, similar to those used to mount conventional curtain walls to the exterior of similar structures.

Each cladding panel 12 includes a frame 14, on which a composite layer 16 is mounted. Optionally, an exterior veneer layer 18 is mounted on composite layer 16.

Optionally, as well, openings, such as a window, door or louvered openings may be formed within a panel 12. A window 50 in a corresponding opening in panel 12 is depicted in FIG. 1. As will become apparent such opening is typically framed.

Frame 14 is made of a metal or alloy, and includes several vertical mullions 30*a*, 30*b*, 30*c* and 30*d* (individually and collectively mullion(s) 30) extending between horizontally extending top and bottom transoms 32*a*, 32*b* (individually and collectively mullion(s) 32). Mullions 30 and transoms 32 may for example be formed of steel, aluminium or other suitable materials known to those of ordinary skill. Mullions 30 and transoms 32 may be extruded, or formed otherwise; they may also be hollow, as for example illustrated in cross-section in FIGS. 2, 2A and 4-7. Mullions 30 may be attached to transom 32 by fasteners, welds, or any other suitable attachment mechanism. In the depicted embodiment, as shown in FIG. 1, frame 14 includes four mullions 30—two outer ones 30*a* and 30*b* at the left and right side of frame, and two further interior mullions 30*c* and 30*d*, spaced generally equally between outer mullions 30*a* and 30*b*.

Figure 5:
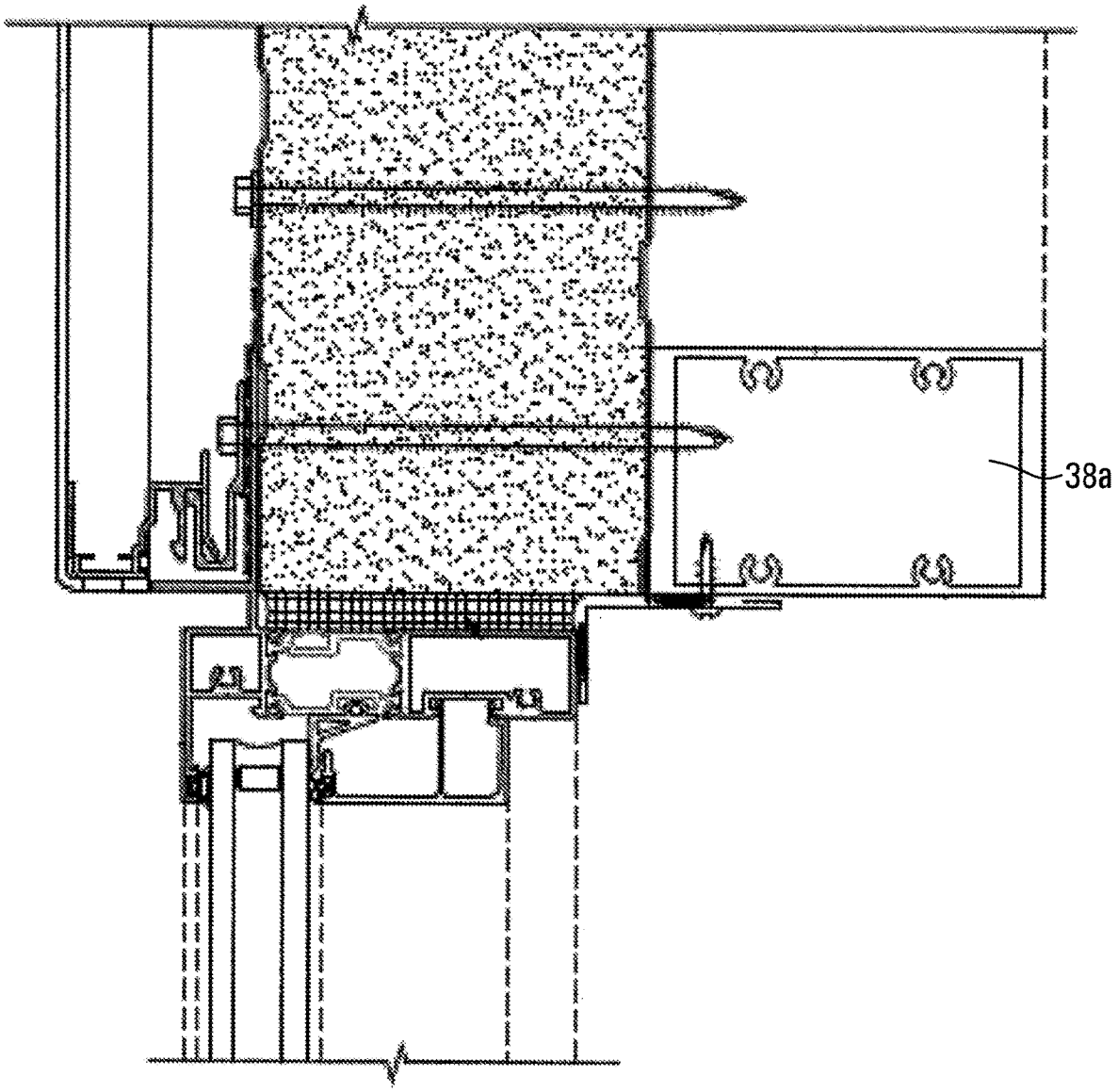
Figure 6:
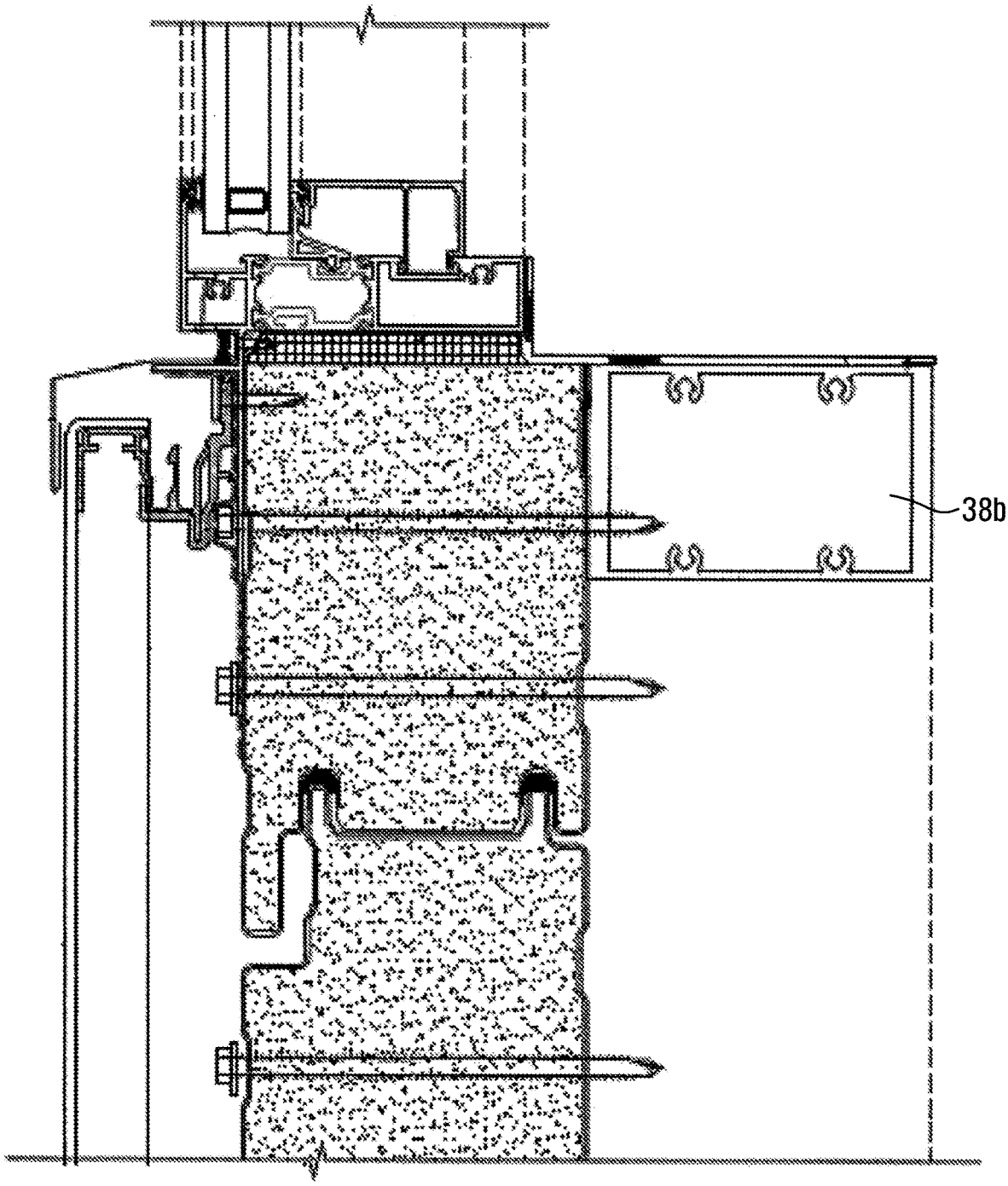
Figure 7:
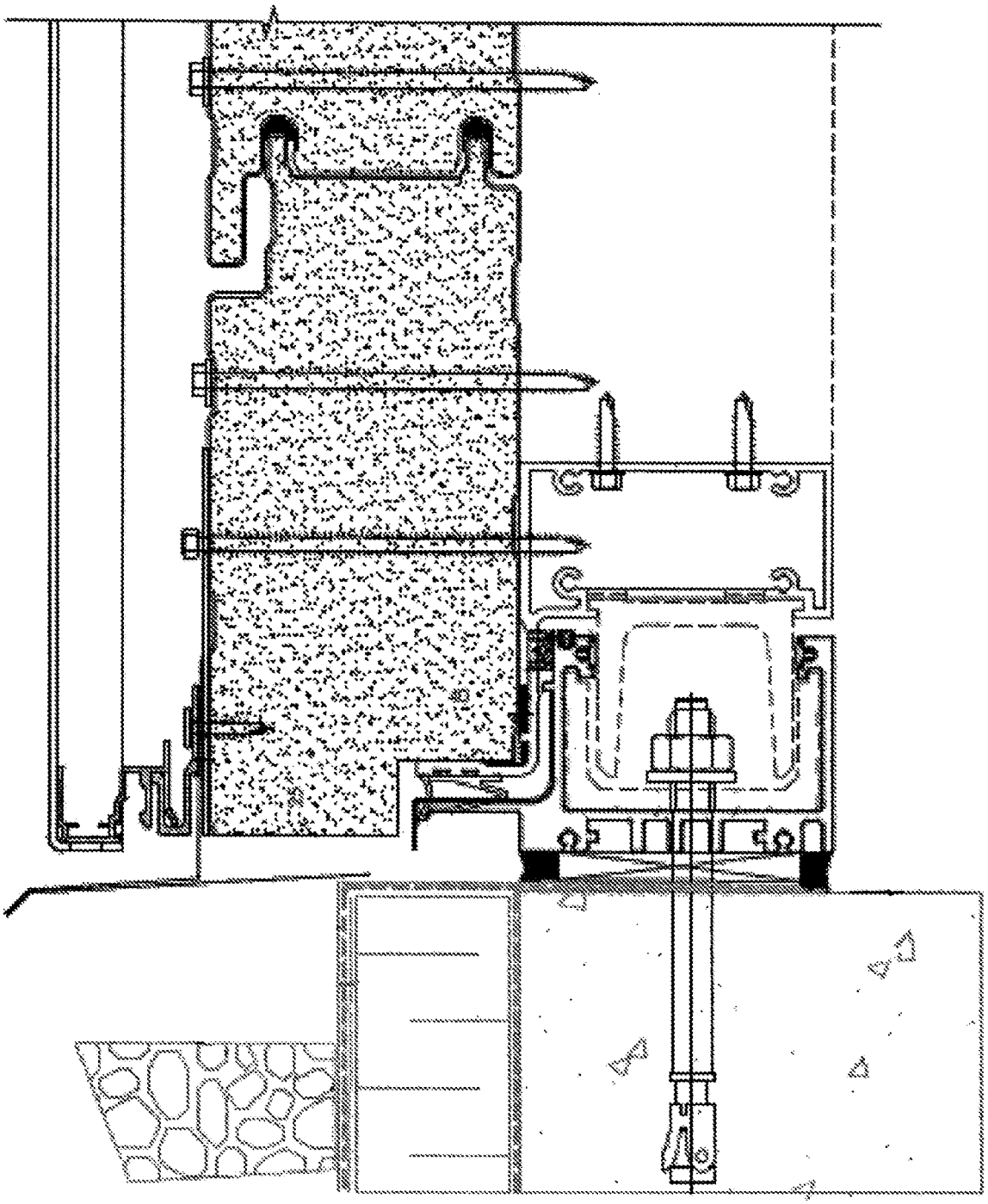

Cross-sectional views near the top and bottom of window 50 are depicted in FIGS. 5 and 6. To that end, frame 14 may include further transoms 38*a*, 38*b* extending between interior mullions 30*c* and 30*d*, used to frame the opening in which window 50 is formed. As will be appreciated additional transoms and mullions (not shown) may be used to frame other architectural features/openings—such as doors, windows, louvers, etc.—that may optionally be added to panel 12.

Depending on the width of panel 12, the number of interior mullions 30 on a frame 14 may vary. The number of mullions 30 may be chosen to provide a relatively uniform spacing between vertically extending mullions 30 of about 0.75-3 meters. In an embodiment, the distance between mullions 30 is nominally about 1.5 m center to center. Of course, this distance could be greater or less, depending on spans, wind loads, and the weight or type of veneer 18. Panels 12, further, typically have a height corresponding to the distance between floor and ceiling of a typical building. In this way a single row of panels 12 may span a floor of a structure/building.

A composite layer 16 is formed from one or more composite panel segments 34*a*, 34*b*, 34*c* (individually and collectively panel segment 34).

Composite layer 16 is attached to the outer face of frame 14, proud of frame 14. Composite panel segments 34*a*, 34*b* interlock to each other. Likewise panel segment 34*b* and 34*c* to form layer 16 that is co-extensive with frame 16. In this way, the front face of layer 16 is generally flat, allowing panel 12 to be generally flat. Moreover, composite layer effectively covers and insulates frame 14.

Each composite panel segment 34 may be formed as an insulated metal panel. To that end, each composite panel segment 34 includes opposed, relatively thin (e.g. 0.4-2 mm (and typically between 0.4 and 0.8 mm))) metal layers 40*a*, 40*b*, on either side of an insulation layer 42. Insulation layer 42 may, for example, be between 50 and 300 mm. Suitable insulating materials include polyurethane (e.g. spray foam polyurethane); Styrofoam; fiberglass; or other suitable insulation material. Insulation layer 42 may be adhered to the metal outer layers 40*a*, 40*b*, for example by way of an adhesive, or by injecting a foam layer between metal outer layers 40*a*, 40*b*. Metal outer layers 40*a*, 40*b*, may, for example, be bent or extruded to form a cavity therebetween. An insulating material in the form of foam, or liquid may be injected into the cavity to form insulation layer 42. Alternatively, metal outer layers may be adhered to a preformed insulation—in the form of foam, bat, or the like. Insulating material may have suitable fire-ratings so that panel 12 is sufficiently fire retardant to be used as an exterior cladding in accordance with applicable building codes. Foam insulation will typically have a density of 32 kg/m$^3$ or greater. Batt insulation will typically have a density of 120 kg/m$^3$ or greater.

As will be appreciated, each composite panel segment 34 has a pre-defined thermal R value, and rigidity. Rigidity will depend on the thickness and type of metal and insulation used. The rigidity of composite panel segment 34 and its fastening to frame 14 effectively allows the composite panel segment to act as diaphragm on frame 14 of each composite panel 12. The in-plane stiffness of the diaphragm transmits the weight of the panel to the end mullions 32*a* and 32*b* of frame 14 where it is transferred to the building structure by fixed connection brackets (e.g. bracket 150 in FIG. 2). The result is cladding panel 12, and a system 10 formed of multiple such cladding panels 12, that has relatively small vertical displacement under load, which permits the interlocking joinery to be much tighter.

Insulated metal panel may, for example, be an insulated metal panel of the type readily manufactured by Kingspan Group, or MetlSpan, and generally available.

Composite panel segments 34 may be formed with predefined dimensions. Conventional metal segments 34, are for example, available in widths of less than 120 cm. Optionally, panel segments 34 may include joints—such as tongue and groove joint 90, formed of as shown in FIG. 2—that may be used to interconnect adjacent panel segments. Tongue and groove joint 90 may include multiple grooves 86 extending along the lateral extent of bottom of panel segment 34, from its bottom and complementary ribs 88 extending from the top edge of composite panel segment 34. Grooves 86 and ribs 88 may be formed in insulation layer 42 and/or from metal or alloy layer extending from metal layers 42*a*/42*b*. In this way, composite panel segments 34 may, for example, be manufactured in a finite number of predefined sizes, and joined to form a composite layer 16 of an arbitrary size, that may be co-extensive with dimensions of frame 14. Assembled, grooves 86 and ribs 88 may be sealed with sealant (e.g. a butyl sealant or similar) to further aid in making layer 16 continuous, and thus provide an effective seal to prevent air and water leakage, and to provide a vapor retarder.

Composite layer 16 may be attached to the exterior facing side of frame 14 by suitable fasteners 98—such as bolts, screws of the like, as illustrated in cross-section in FIG. 2. Fasteners 98 may connect through panel segments 34, and into frame 14 (and in particular into mullions 30 or transoms 32). Fasteners 98 may be self-drilling (and include self-tapping threads), or engage complementary fastener that mates with fasteners 98. For example, fasteners 98 may be machine bolts or screws—and complementary fasteners (not shown) may be nuts.

Optionally, a veneer 18 may be affixed to the exterior of composite layer 16. In the depicted embodiment, veneer 18 may be formed as additional metal panels 66 fabricated from tension-leveled, architectural grade aluminum plates, with optional stiffening ribs (if required). Panel corners may be press formed panels to provide a seamless finish and post painted. Panel corners may be mitred to provide a return edge. Veneer 18 may alternatively be formed of roll formed metal cladding, preformed metal cladding, terracotta tiles or panels, cement panels, high-pressure laminate panels, porcelain tile, brick veneer, or other typical building veneers, known to those of ordinary skill.

Figure 2B:
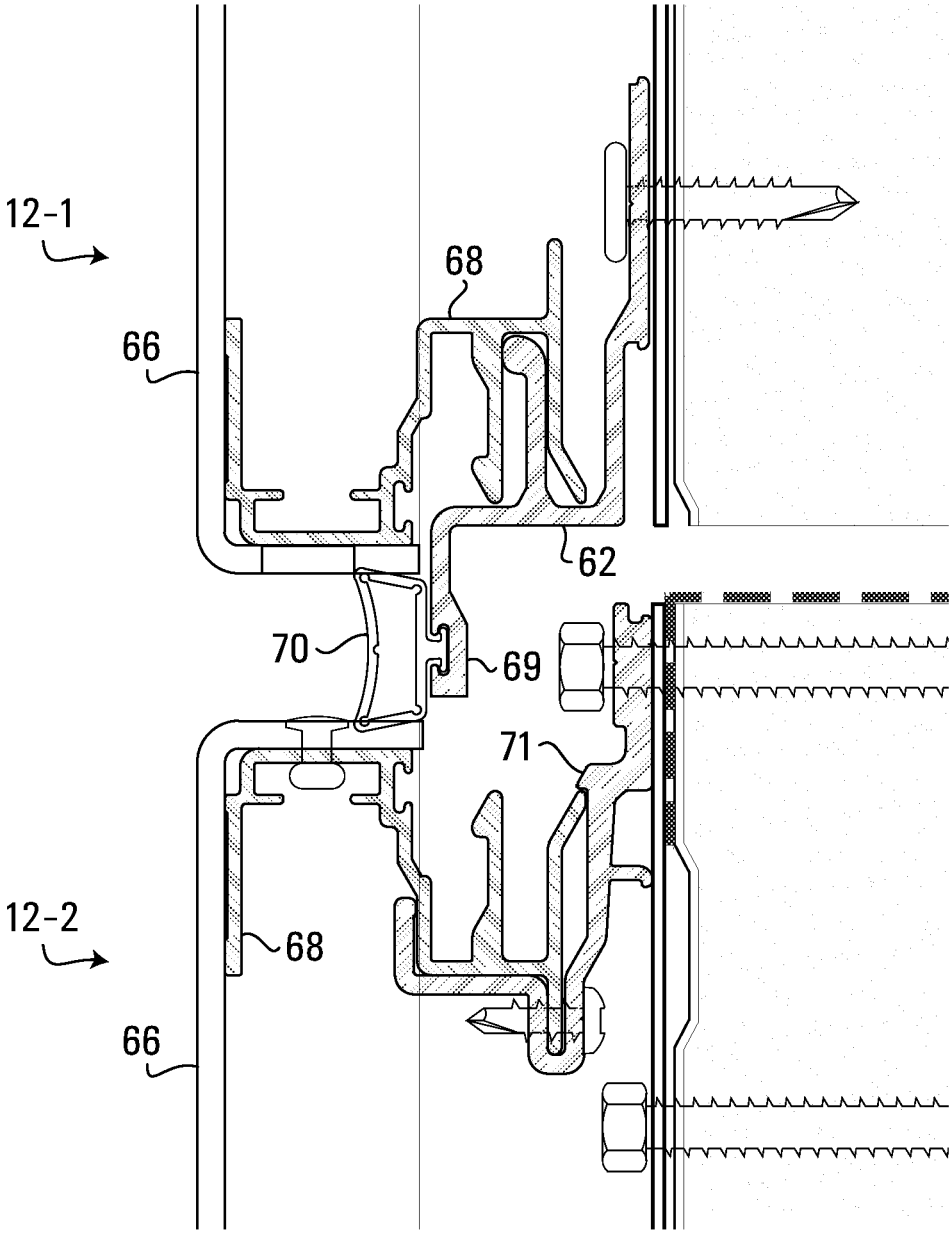
FIG. 2B is a further enlarged portion of FIG. 2 illustrating veneer layer attached to cladding panels of the system of FIG. 1.
Figure 3:
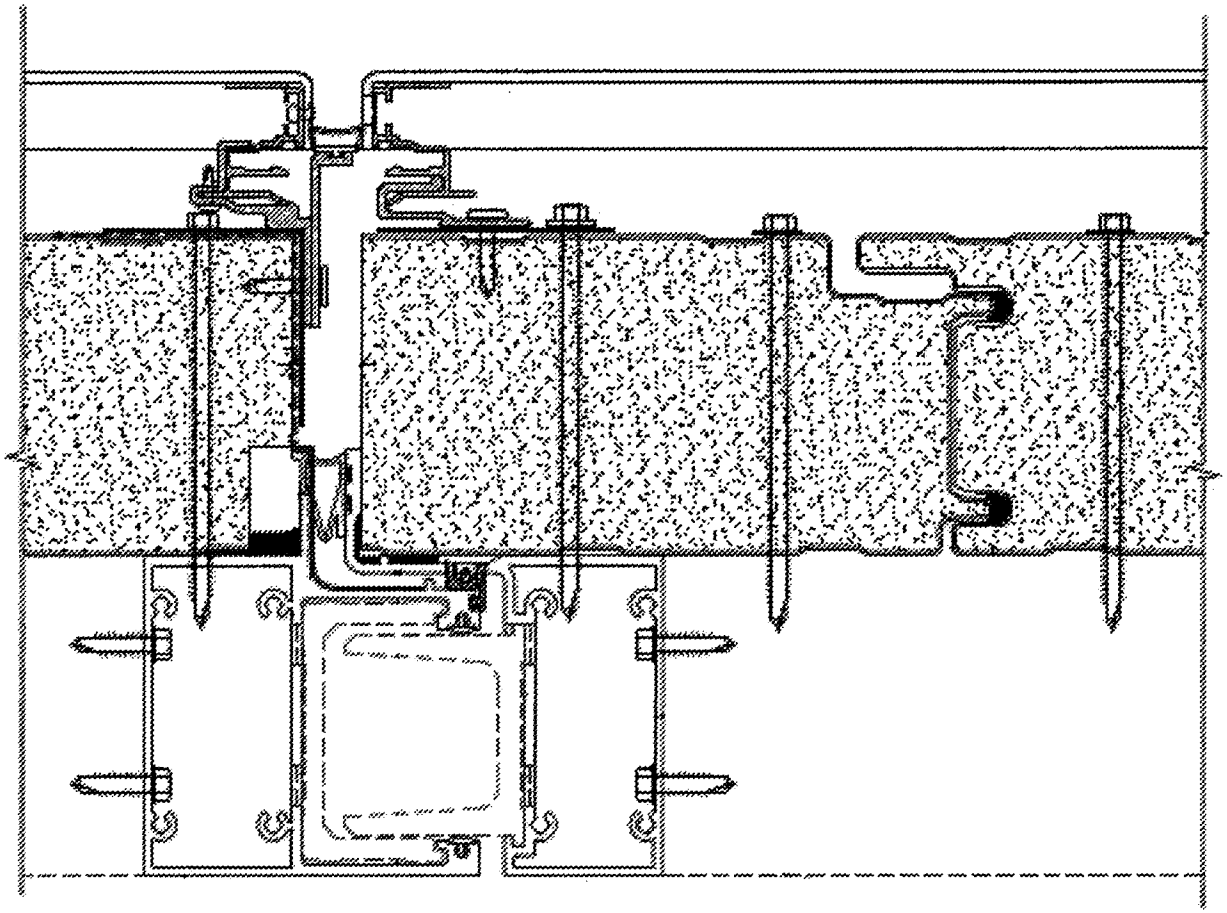
FIG. 3-7 are further cross-sectional views of the cladding panel of FIG. 1.
Figure 4:
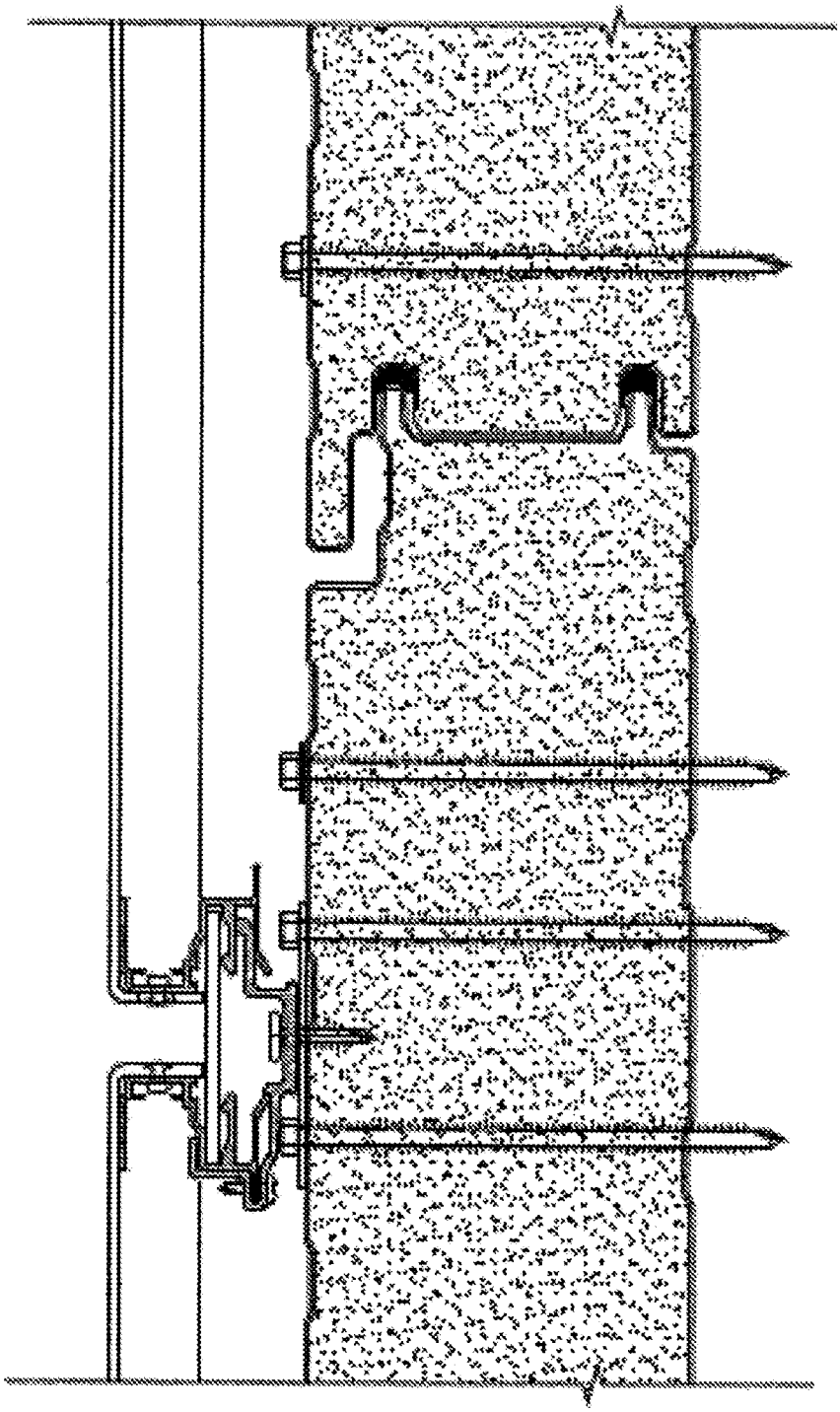

Veneer 18 may be mounted to the exterior of composite layer 16, using laterally extending rails 60, on which veneer 18 may be hung or suspended. Suitable hangers 62 may be used to hang panels 66 on rails 60, as for example illustrated in FIG. 2B. Hangers 62 may be in the form of clip—formed for example of plastic. A complementary clip 68 may be affixed to the ends of panels 66—for example by way of a friction fit, press fit or the like. Clip 68 may interlock (e.g. snap fit) into hanger 62. A downwardly extending portion 69 of clip 68 may further receive an additional weather strip 70 that may extend a seam between top and bottom panels 66 of veneer 18 of adjacent cladding panels 12-2 and 12-1. Weather strip 70 may be formed of rubber, plastic or the like and may be compressible. A complementary clip 71 may also be used in place of hanger 62 to interconnect clip 68, without an extension for mounting a weather strip. Veneer 18, may for example be formed from a metal panel system—like that made available from Northern Facades, of Mississauga, Ontario and sold in association with the Axiom trademark.

Frame 14 may further include complementary tongue and groove, extending from vertical mullions 30*a*/30*b*, and/or horizontal transoms 32*a* or 32*b*, forming tongue and groove assembly 120 to allow frame 14 of adjacent cladding panels 12 to be interconnected on the exterior of building/structure. Tongue/groove assembly 120 formed on two cladding panel 12-1 and 12-2, is illustrated in cross-section in FIG. 2 and in an enlarged view in FIG. 2A. In FIG. 1, only rails are only depicted as extended from mullions 30*a*/30*b*.

However such rails also typically extend from transoms 32*a* and 32*b* to interconnect vertically and horizontally adjacent panels 12. As illustrated in FIG. 2, tongue/groove assembly 120 may be formed of two complementary generally U-shaped strips 130, 132, each having opposed outwardly extending ribs 122 and 124, extending from a base 126 or 128. The spacing between ribs 124 on one of the strips 116, is wider than ribs 122 of the other strip 118, allowing ribs 122 to be placed between ribs 124, thereby completing a tongue and groove connection between bottom transom 32*b* of one panel (e.g. panel 12-1), with transom 32*a* of another panel (e.g. panel 12-2). Connection strips 130, 132 may be formed of extruded aluminium, steel, or another alloy, and affixed to transoms using suitable mechanical fasteners (e.g. screws; rivets; bots; etc.) or using a suitable adhesive.

Optionally a further weather strip 140, formed of rubber, plastic, or the like may extend from, and parallel to the lengthwise extent of one of connection strips 130, 132. As illustrated, a hook shaped extrusion 142 extends parallel to connection strips 132/134, and carries weather strip 142. Once connection strips 130/132 are interconnected, weather strip 140 sits in the seam between composite layer 16 of adjacent panels (e.g. panels 12-1, 12-2 of FIG. 2). Thus, system 10 may provide a weather sealed building envelope.

Vertically adjacent panels 12 may be installed at a distance, equal to approximately the thickness of strip 140. Layers 16 of adjacent cladding panels 12 may thus be separated by a relatively narrow seam, providing a continuous planar surface on the exterior of the building. Strip 140 may for example have dimensions of about 10-15 mm×25-35 mm. Strip 140 may be compressed between layers 16 of adjacent cladding panels 12 to provide insulated seems having a thickness of less than 10 mm (e.g. 8 mm). The planar surface may thus allow for a relatively continuous veneer—like example veneer 18.

Strip 140 may fill horizontal seems, further making the building envelope formed by system 10 continuous. As well, as strip 140 are also located proud of transoms 32 (and mullions 30), they further insulate these from the environment.

A similar arrangement for vertically extending rails, extending from vertical mullions 30*a*/30*b* of adjacent panels is depicted in FIG. 8. Again, complementary rails forming a tongue and groove joint to interconnect horizontally adjacent panels is depicted. A weather seal extends into the vertical seem between composite layer 16 of the adjacent cladding panels 12, proud of mullions 30.

As noted, panels 12 typically have a height (i.e. between transoms 32*a* and 32*b*) equal to the distance between floor and ceiling of a typical building. In this way, transoms 32*a* and 32*b* may be affixed to the subfloors of a building. Conveniently, the exterior mullions 32*a*, 32*b* may be affixed to structural pillars of the building. In this way, wind loads are absorbed by the subfloors of the building, while the weight of panels 12 are supported by through the vertical mullions 32*a*, 32*b*. Of note, the bottom most panel 12 on the exterior of a structure may be mounted directly to the foundation slab, base or curb of a structure, as for example illustrated in FIG. 7.

As illustrated in FIGS. 2, anchor(s) 150 may be suitably attached to the building/structure to carry mullions 30. Anchor 150 may be a conventional curtain wall anchor, in the form of an L-shaped bracket to which mullions 30 may be bolted or otherwise affixed. The attachment of anchor(s) 150 is typically pre-planned with the design of cladding system 10 for any particular building.

Additionally, as frame 14 is behind composite layer 16, frame 14 is thermally insulated from exterior temperatures, allowing the entire building envelope formed by cladding system 10 to act as an insulation layer and air and vapour barrier to a structure on which system 10 is mounted.

Of course, the above described embodiments are intended to be illustrative only and in no way limiting. The described embodiments are susceptible to many modifications of form, arrangement of parts, details and order of operation. The invention is intended to encompass all such modification within its scope, as defined by the claims.

What is claimed is:

1. A modular cladding system mounted to the exterior of a building, comprising:

a plurality of cladding panels pre-manufactured for mounting to the exterior of the building, each cladding panel comprising a frame, comprising top and bottom transoms; and left and right mullions extending vertically therebetween, proximate left and right ends of the top and bottom transoms;

a cladding layer formed of opposed metal layers and an insulating core to which the opposed metal layers are adhered;

wherein the cladding layer is coextensive with the frame, and is formed in front of the frame to thermally insulate the frame, once installed to the exterior of the building, and acts as a diaphragm extending between the left and right mullions;

a connecting rib, extending from at least one of the left and right mullions to allow interconnection of the cladding panel to a connecting rib of an adjacent cladding panel on the building;

wherein the modular cladding system is mounted to the building by mounting at least one of the top and bottom transoms of some of the plurality of cladding panels to a floor of the building, and wherein connecting ribs of adjacent panels of the plurality of cladding panels are interconnected with each other.

2. The panel system of claim 1, wherein the frame includes a connecting rib, extending from at least one of the vertical top and bottom transoms, to allow interconnection of each of said cladding panels to an adjacent cladding panel on the building.

3. The panel system of claim 2, further comprising a weather strip between vertical and horizontal seams between adjacent cladding panels.

4. The panel system of claim 3, wherein the adjacent cladding panels provide a substantially vapour sealed building envelope.

5. The panel system of claim 2, wherein each connecting rib comprises a tongue or groove, of a tongue and groove connector.

6. The panel system of claim 3, wherein the adjacent cladding panels provide a substantially air sealed building envelope.

7. The panel system of claim 1, wherein the insulating core of the cladding layer is adhered to each of said opposed metal layers by an adhesive.

8. The panel system of claim 1, wherein the insulating core is injected between the opposed metal layers.

9. The panel system of claim 1, wherein the cladding layer of each cladding panel, has a generally uniform thickness.

10. The panel system of claim 1, wherein the mullions are formed of metal or alloy.

11. The panel system of claim 10, wherein the mullions or transoms are extruded.

12. The panel system of claim 1, wherein the transoms are formed of metal or alloy.

13. The panel system of claim 1, further comprising a veneer layer attached to the cladding layer.

14. The panel system of claim 13, wherein the veneer layer is formed as one or more steel panels co-extensive with, and affixed to the cladding layer.

15. The panel system of claim 13, wherein the veneer layer is formed as terracotta tiles or panels, cement panels, high-pressure laminate panels, porcelain tile, or brick veneer.

16. The panel system of claim 13, wherein the veneer layer comprises metal panels, terracotta tiles, brick, high-pressure laminate, or fibre cement.

17. The panel system of claim 1, wherein at least one of said cladding panels comprises a framed opening formed therein.

18. The panel of claim 17, wherein the opening comprises a window, door or louver.

19. The panel system of claim 1, wherein at least some of the mullions of the plurality of panes are mounted to pillars of the building.

20. A building envelope, comprising a modular cladding system mounted to the exterior of the building, the building envelope comprising:

a plurality of pre-manufactured cladding panels, mounted adjacent to each other on the exterior of the building, each cladding panel comprising a frame, comprising top and bottom transoms; and left and right mullions extending vertically therebetween, proximate left and right ends of the top and bottom transoms;

a cladding layer formed of opposed metal layers and an insulating core to which the opposed metal layers are adhered;

wherein the cladding layer is coextensive with the frame, and is formed in front of the frame to thermally insulate the frame, once installed to the exterior of the building, and acts as a diaphragm extending between the left and right mullions;

a connecting rib, extending from at least one of the left and right mullions to allow interconnection of the cladding panel to a connecting rib of an adjacent cladding panel on the building;

wherein the modular cladding system is mounted to the building by mounting at least some of the top and bottom transoms of at least some of the cladding panel to a floor or pillar of the building, and wherein connecting ribs of adjacent panels of the plurality of cladding panels are interconnected with each other; and a plurality of weather strips formed between the cladding layer of adjacent cladding panels to seal the building envelope.

21. The building envelope of claim 20, wherein each of said panels further comprises a paneled veneer layer attached to the exterior of the cladding layer of each of said panels.

22. The building envelope of claim 21, further comprising a second plurality of weather strips formed between the veneer layer of adjacent cladding panels to seal the building envelope.

23. The building envelope of claim 20, wherein adjacent panels of the modular cladding system are interlocked to each other by way of a tongue and groove connector, extending from the horizontal or vertical edge of the frame of adjacent panels.

* * * * *